US005139930A

United States Patent [19]

Kadowaki et al.

[11] Patent Number: 5,139,930

[45] Date of Patent: Aug. 18, 1992

[54] SILVER HALIDE PHOTOGRAPHIC LIGHT-SENSITIVE MATERIAL

[75] Inventors: Takashi Kadowaki; Kaoru Onodera, both of Odawara, Japan

[73] Assignee: Konishiroku Photo Industry Co., Ltd., Tokyo, Japan

[21] Appl. No.: 829,539

[22] Filed: Feb. 3, 1992

Related U.S. Application Data

[63] Continuation of Ser. No. 571,827, Aug. 24, 1990, abandoned, which is a continuation of Ser. No. 469,805, Jan. 22, 1990, abandoned, which is a continuation of Ser. No. 336,508, Apr. 12, 1989, abandoned, which is a continuation of Ser. No. 211,175, Jun. 23, 1988, abandoned, which is a continuation of Ser. No. 83,927, Aug. 4, 1987, abandoned, which is a continuation of Ser. No. 724,689, Apr. 19, 1985, abandoned.

[30] Foreign Application Priority Data

Apr. 20, 1984 [JP] Japan ..... 59-80588

[51] Int. Cl.[5] ..... G03C 1/84; G03C 7/26; G03C 7/34

[52] U.S. Cl. ..... 430/507; 430/522; 430/552; 430/553

[58] Field of Search ..... 430/522, 552, 553, 505, 430/507, 549

[56] References Cited

U.S. PATENT DOCUMENTS

| | | | |
|---|---|---|---|
| 2,274,782 | 3/1942 | Gaspar | 430/522 |
| 2,533,472 | 12/1950 | Keyes et al. . | |
| 2,956,879 | 10/1960 | Van Campen . | |
| 3,148,187 | 9/1964 | Heseltine . | |
| 3,177,078 | 4/1965 | Bockly et al. . | |
| 3,247,127 | 4/1966 | Bailey . | |
| 3,540,887 | 11/1970 | Depoorter et al. . | |
| 3,575,704 | 4/1971 | Salesin . | |
| 3,653,905 | 4/1972 | . | |
| 3,718,472 | 2/1973 | Oliver et al. . | |
| 3,746,546 | 7/1973 | Tsuji et al. | 430/522 |
| 3,865,187 | 2/1975 | Kobayashi et al. | 430/522 |
| 3,932,188 | 1/1976 | Tanaka et al. | 430/522 |
| 3,989,528 | 11/1976 | Sugiyama | 430/522 |
| 4,070,352 | 1/1978 | Maner et al. . | |
| 4,071,312 | 1/1978 | Blackwell . | |
| 4,130,430 | 12/1978 | Sugiyama et al. | 430/522 |
| 4,179,294 | 12/1979 | Sugiyama et al. | 430/522 |
| 4,500,635 | 2/1985 | Aoki et al. | 430/553 |
| 4,513,079 | 4/1985 | Sakanoue et al. | 430/553 |
| 4,892,812 | 1/1990 | Kohmura et al. | 430/522 |

FOREIGN PATENT DOCUMENTS

| | | | |
|---|---|---|---|
| 48-85130 | 11/1973 | Japan . | |
| 49-99620 | 9/1974 | Japan . | |
| 49-114420 | 10/1974 | Japan . | |
| 0034716 | 3/1977 | Japan | 430/522 |
| 52-108115 | 9/1977 | Japan . | |
| 584609 | of 0000 | United Kingdom . | |
| 1177429 | 1/1970 | United Kingdom . | |
| 1373026 | 11/1974 | United Kingdom . | |
| 1433102 | 4/1976 | United Kingdom . | |

*Primary Examiner*—Richard L. Schilling
*Attorney, Agent, or Firm*—Finnegan, Henderson, Farabow, Garrett and Dunner

[57] ABSTRACT

A silver halide photographic light-sensitive material which contains, on a support, a compound represented by the following Formula [I]:

wherein $R_1$ is alkyl, cycloalkyl, aryl, heterocyclic, alkoxy, aryloxy, alkylamino or arylamino;

$R_2$ is hydrogen, halogen, alkyl or alkoxy;

$R_3$ is alkyl, cycloalkyl or aryl; or $R_2$ and $R_3$ may be bonded together to form a 5- or 6-membered ring condensed to the phenolic ring; and Z is hydrogen or a group releasable by the coupling reaction with the oxidation product of an organic primary amine color developing agent, and a compound represented by the following Formula [II]:

where $R_4$ and $R_5$ are alkyl, aryl, —COOH', —COOR', —OR', —NR', —NR'R'', —CN, —NHCOR', —NHCONHR', or —CONHR', where R' and R'' are alkyl or aryl; and $R_6$ and $R_7$ are alkyl or aryl containing at least one carboxy group or sulfonic acid group.

7 Claims, No Drawings

SILVER HALIDE PHOTOGRAPHIC LIGHT-SENSITIVE MATERIAL

This application is a continuation, of application Ser. No. 07/571,827 filed Aug. 24, 1990, now abandoned, which is a continuation of application Ser. No. 07/469,805, filed Jan. 22, 1990, now abandoned, which is a continuation of application Ser. No. 07/336,508, filed Apr. 12, 1989, now abandoned, which is a continuation of application Ser. No. 07/211,175, filed Jun. 23, 1988, now abandoned, which is a continuation of application Ser. No. 07/083,927, filed Aug. 4, 1987, now abandoned, which is a continuation of application Ser. No. 06/724,689 filed Apr. 19, 1985, now abandoned.

BACKGROUND OF THE INVENTION

1. Field of the Invention

The present invention relates to a silver halide photograhic light-sensitive material and more particularly, to a silver halide color photographic light-sensitive material for a print.

2. Description of the Prior Art

A color light-sensitive material for a print is, usually, spectrographically sensitized using a silver halide and a sensitization coloring dye in accordance with a three-color separation process for a color reproducing purpose. This material contains a yellow color coupler in a blue-sensitive silver halide emulsion layer, a magenta color coupler in a green-sensitive silver halide emulsion layer and a cyan color coupler in a red-senstive silver halide emulsion layer. After exposing imagewise, the material is subjected to a color development using a color developer containing a p-phenylene diamine derivative as a color developing agent to form a color dye image and a silver image.

A bleaching and fixing treatments or a bleach-fix treatment are then conducted to remove the silver image, thus providing the color dye image.

However, such color dye image is not always stable to light, heat, moisture, etc., and particularly, the cyan color dye is greatly faded due to heat or moisture. The print thereof kept in an album has been often to get reddish brown.

The stabilization of a color dye image, which is important in that the color print is capable of serving as a hard copy, has been studied by many researchers. p However, the studies of cyan couplers and color dye image stabilizers have provided no effective results, but recently, 2,5-diacyl aminophenol type cyan coupler attracts the attention as a cyan coupler for a color dye image having an excellent heat- and moisture-resistance, and the studies thereof have been made. Such studies are disclosed, for example, in Japanese Patent Publication Open to Public Inspection (hereinafter called Japanese Patent O.P.I. Publication) Nos. 109630/1978, 163537/1980, 29235/1981, 55945/1981, 65134/1981, 80045/1981, 99341/1981, 104333/1981, 161541/1981, 161542/1981, 136649/1982, 136650/1982, 142640/1982, 144548/1982, 150848/1982, 157246/1982, 105229/1983, 31334/1983, 134635/1983, 106539/1983, 31953/1984, and 31954/1984, and U.S. Pat. Nos. 4,333,999, 2,772,162, 3,880,661, and 3,758,308.

Other basic requirements for selecting cyan couplers include a light-resistance, spectroabsorptive characteristics of the color dye thereof, etc., and whereby a desirable cyan coupler is selected.

In these 2,5-dicyan amine-type cyan couplers, however, it has been obvious from our studies that the sensitivity thereof is lowered, i.e., a so-called latent image regression is deteriorated for a period of time up to the development after exposed imagewise to light.

This phenomenon appears greatly, particularly under a condition of high temperature and high moisture, resulting in a great hindrance even in a normal printing operation. This has come into a great problem in practicing such excellent cyan couplers.

On the other hand, other important characteristics required for a color light-sensitive printing material include a image quality, and among others, particularly, a sharpness will exert a great influence on the image quality. For the purpose of improving the sharpness, the studies have been continued on anti-irradiation dyes, anti-halation dyes, supports and layer arrangements, and among these, dyes have presented a great effect on the sharpness, and have been zealously examined. The characteristics, as such dyes will be selected, include 1) a spectroabsorptive characteristic and 2) an elusivity during treatment. Oxonol, azo and anthraquinone type dyes have been researched as those meeting these characteristics. Among these, particularly, oxonolpyrazolone dyes are excellent. These are described, for example, in Japanese Patent Examined Publication Nos. 22069/1964, 13168/1968, 1419/1976, 46607/1976, and 10059/1980; Japanese Patent O.P.I. Publication No. 145125/1975, Japanese Patent Examined Publication Nos. 10187/1980, 28085/1978, 10060/1980, 10061/1980 and 10899/1080; Japanese Patent O.P.I. Publication No. 33104/1980 and British Patent No. 1,338,799; and methods for preparing these dyes are described in Japanese Patent Examined Publication No. 3504/1968, Japanese Patent O.P.I. Publication No. 99620/1974, Japanese Patent Examined Publication No. 38056/1977, Japanese Patent O.P.I. Publication No. 91627/1975 and Japanese Patent Examined Publication Nos. 38129/1979 and 20967/1979.

However, these oxonolpyrazolone dyes have the characteristics to affect a silver halide to increase fogs. For the purpose of preventing such fogs, the examinations have been made of an anti-fogging agent, a mordant, a modification of an emulsion-added layer and the like, but in these examinations, no satisfactory effect is obtained.

OBJECTS OF THE INVENTION

It is therefore an object of the present invention to provide a silver halide photographic light-sensitive material having an excellent dark-keeping property.

Another object of the present invention is to provide a silver halide photographic light-sensitive material having an superior sharpness.

A further object of the present invention is to provide a silver halide photographic light-sensitive material having an excellent stability in latent image and a good whiteness.

SUMMARY OF THE INVENTION p It has been found that the above objects of the present invention are accomplished at a stroke by the following constitution of the present invention.

The constitution of the present invention resides in a silver halide photographic light-sensitive material which contains a compound represented by the following Formula [I] and a compound represented by the following Formula [II] on a support.

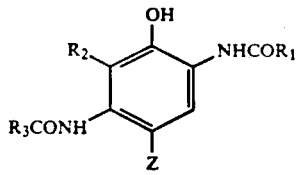

wherein $R_1$ represents an alkyl, cycloalkyl, aryl, heterocyclic, alkoxy, aryloxy, alkylamino or arylamino group; $R_2$ represents hydrogen, a halogen, an alkyl or alkoxy group; and in addition, $R_3$ represents an alkyl, cycloalkyl or aryl group, $R_2$ and $R_3$ may be bonded together to form a 5- or 6-membered ring condensed to the phenolic ring; and Z represents hydrogen, or a group releasable by the coupling reaction with the oxidation product of an aromatic primary amine color developing agent.

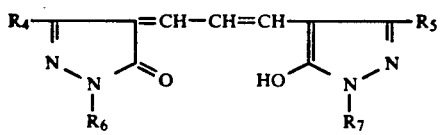

wherein $R_4$ and $R_5$ are respectively an alkyl or aryl group, —COOH, —COOR', —OR', —NR', —NR'R", —CN, —NHCOR', —NHCONHR' or —CONHR' wherein R' and R" represents an alkyl or aryl group, respectively; and $R_6$ and $R_7$ are respectively an alkyl or aryl group containing at least one carboxy group or sulfonic acid group.

DETAILED DESCRIPTION OF THE INVENTION

The present invention will now be described in more detail.

In the present invention, alkyl groups represented by $R_1$ in Formula [I] are preferably an straight or branched alkyl groups containing 1 to 20 carbon atoms, such as, for example, methyl, ethyl, i-propyl, t-butyl, dodecyl or pentadecyl group. Cycloalkyl groups denoted by $R_1$ are cyclohexyl group, for example, and heterocyclic groups are preferably five- or six-membered. For example, the 5-membered heterocyclic groups are thienyl, pyrrolyl, furyl, thiazolyl, imidazolyl, pyrazolyl, succinimide, triazolyl and tetrazolyl groups. The 6-membered heterocyclic groups are pyridyl, pyrimidyl, triazinyl, thiazianyl and dithiazinyl groups. These heterocyclic groups may form, with benzene ring, condensed rings such as for example, brinyl indazolyl, benzoxazolyl, benzimidazolyl, quinolyl, indolyl or phthalimide group.

In the present invention, aryl groups denoted by $R_1$ are, for example, phenyl and naphthyl groups, and preferably, phenyl group. Examples of alkoxy group denoted by $R_1$ is methoxy, ethoxy and t-butoxy groups, and examples of aryloxy groups are phenoxy and naphthoxy groups. Examples of alkylamino group denoted by $R_1$ are N,N-di-t-butylamino, N-dodecylamino and N-pentadecylamino groups, and arylamino groups include amilino group. Each of these groups may be substituted.

In the present invention, $R_1$ is preferably phenyl group or an alkyl group, and when the alkyl group is substituted, the preferred substituents are halogen atoms such as fluorine, chlorine and bromine atoms, and particularly, the alkyl group is preferred to be a fluorine atom-substituted alkyl group. When the phenyl group denoted by $R_1$ is substituted, specified examples of such substituents are a halogen atom (e.g., chlorine and fluorine atoms), hydroxyl, nitro, cyano, alkyl (e.g., methyl, ethyl, t-butyl and dodecyl), carboxylic acid (e.g., —COOH, —COONa), sulfonic acid (e.g., —$SO_3H$ and —$SO_3Na$), alkylamino (e.g., N,N-dimethylamino, N,N-diethylamino and N-butylamino), arylamino (e.g., anilino) alkylsulfonyl (e.g., methyl- and ethyl-sulfonyl), arylsulfonyl (e.g., phenyl-sulfonyl), alkoxy (e.g., methoxy, ethoxy and t-butoxy), aryloxy (e.g., phenoxy and naphthoxy), alkylcarbonyl (e.g., acetyl and propionyl), arylcarbonyl (e.g., benzoil), alkyloxycarbonyl (e.g., methoxy- and ethoxy-carbonyl), aryloxycarbonyl (e.g., phenoxycarbonyl), alkylcarbonyloxy (e.g., acetoxy, propionyloxy), arylcarbonyloxy (e.g., benzoiloxy), alkyloxysulfonyl (e.g., methoxy- and ethoxy-sulfonyl), aryloxysulfonyl (e.g., phenoxysulfonyl), alkylsulfonyl (e.g., methyl- and ethyl-sulfonyloxy), arylsulfonyloxy (e.g., phenylsulfonyloxy), alkylacylamino (e.g., acetylamino and propionylamino), arylacylamino (e.g., benzoilamino), alkylcarbamoyl (e.g., methylcarbamoyl and ethylcarbamoyl), arylcarbamoyl (e.g., phenylcarbamoil), alkylsulfonamide (e.g., methanesulfonamide and ethanesulfonamide), arylsulfonamide (e.g., benzensulfonamide), alkylsulfamoyl (e.g., methylsulfamoyl), alkylaminosulfonamide (e.g., N,N-dimethylaminosulfonamide), arylaminosulfonamide (e.g., N-phenylaminosulfonamide), alkylureido (e.g., methylureido and ethylureido), arylureido (e.g., N-phenylureido), alkyloxazolyl (e.g., methyloxazolyl), and aryloxazolyl (e.g., phenylorazolyl) groups. One to five of these substituents are introduced into the phenyl group. Preferred substituents introduced into the phenyl group include a halogen, an alkyl (particularly, halogen atom-substituted alkyl), cyano, alkylsulfonamide, arylsulfonamide, alkylsulfamoyl, arylsulfamoyl, alkylureido, arylureido, alkyloxycarbonyl, aryloxycarbonyl, alkylcarbonyloxy and arylcarbonyloxy groups.

A halogen denoted by $R_2$ in Formula [I] is chlorine, fluorine, etc., for example; and alkyl groups denoted by $R_2$ are linear or branched alkyl groups, including methyl, ethyl and t-butyl groups, for example. Alkoxy groups denoted by $R_2$ are methoxy, ethoxy and t-butoxy groups, for example. Each of these groups may be substituted. Preferably, $R_2$ is hydrogen or chlorine, or methyl group.

Alkyl groups denoted by $R_3$ in Formula [I] are straight or branched groups such as ethyl, butyl, isopentyl, hexyl, sec-octyl, undecyl, dodecyl, tridecyl, tetradecyl, pentadecyl, hexadecyl and octadecyl groups, and preferably, alkyl groups containing 1 to 30 carbon atoms. These alkyl groups may be substituted, and the representatives of these substituents include phenoxy [which may have further substituents including typically a halogen (e.g., fluorine and chlorine), and hydroxyl, nitro, cyano, alkyl (e.g., methyl, butyl and dodecyl), alkoxy (e.g., methoxy and ethoxy), aryl (e.g., phenyl and tolyl), aryloxy (e.g., phenoxy and naphthoxy, aralkyl (e.g., benzyl), alkylsulfamoyl (e.g., butylsulfamoyl), arylsulfamoyl (e.g., phenylsulfamoyl), alkyloxycarbonyl (e.g., n-cotyloxycarbonyl), aryloxycarbonyl (e.g., phenoxycarbonyl), alkylsulfonamide (e.g., butylsulfonamide) and arylsulfonamide groups (e.g., phenylsulfonamide)]; and alkylacylamino, arylacylamino, alkylthio, arylthio, alkylsulfonyl, arylsulfonyl, alkoxy, alkyloxycarbonyl and aryloxycarbonyl groups. Two or more of these substituents may be introduced into the alkyl group.

Examples of cycloalkyl groups denoted by $R_3$ are cyclobutyl, cyclopentyl, cyclohexyl, and cyclobutyl groups, and preferably, cyclohexyl group. These cycloalkyl groups may be substituted.

Examples of aryl groups denoted by $R_3$ are phenyl and naphthyl groups, and preferably, phenyl group. These aryl groups may be substituted, and the representatives of such substituents are a halogen (e.g., chlorine and fluorine), and hydroxyl, nitro, cyano, alkyl (e.g., methyl, butyl and dodecyl), alkoxy (e.g., methoxy and ethoxy), aryl (e.g., phenyl and tolyl), aryloxy (e.g., phenoxy), alkylsulfamoyl (e.g., butylsulfamoyl), arylsulfamoyl (e.g., phenylsulfamoyl), alkyloxycarbonyl (e.g., n-octyloxycarbonyl), aryloxycarbonyl (e.g., phenoxycarbonyl) alkylsulfonamide (e.g., butylsulfonamide), arylsulfonamide (e.g., phenylsulfonamide), alkylsulfonyl (e.g., dodecylsulfonyl and arylsulfonyl (e.g., phenylsulfonyl) groups.

Preferred groups denoted by $R_3$ in Formula [I] are alkyl and aryl groups, and more preferred groups are those represented by the following Formula [III]:

$$R_9\text{-}(X\text{—}R_8)_n \qquad \text{Formula [III]}$$

wherein n is an integer of 0 or 1, and $R_8$ represents alkylene groups {for example, α-ethylmethylene, α-butylmethylene, α-dodecylmethylene, α-butylmethylene and α-dodecylmethylene groups, wherein the carbon atom in the α-position of the ethylene group indicates the carbon directly bonded to the carbon atom of the acylamino group in Formula [I]}; or arylene groups such as phenylene group. X represents divalent groups such as —O—, —COO—, —OCO—, —$SO_2$—, —S—, —$NHSO_2$—, —$SO_2NH$—, —CONH— or —NHCO—, and preferably, —O— or —$SO_2$—.

$R_9$ represents straight or branched alkyl groups (including those having 1 to 20 carbon atoms, such as n-butyl, n-pentyl, n-octyl, n-nonyl, n-dodecyl, n-hexadecyl, n-octadecyl, sec-pentadecyl, sec-tridecyl, t-octyl and t-nonyl groups), or aryl groups (such as phenyl group). These alkyl and aryl groups may be substituted. For example, the representatives of substituents of phenyl group are a halogen (such as fluorine, chlorine and bromine), and hydroxyl, cyano, nitro, alkyl (such as methyl, ethyl, butyl, pentyl, octyl, dodecyl, etc.), alkoxy (such as methoxy, ethoxy, butoxy, octyoxy, etc.), alkylsulfamoyl (such as butylsulfamoyl, octylsulfamoyl, etc.), arylsulfamoyl (such as phenylsulfamoyl, xylylsulfamoyl, tolylsulfamoyl, mesitylsulfamoyl, etc.), alkyloxycarbonyl (such as methyloxycarbonyl, butyloxycarbonyl, etc.), aryloxycarbonyl (such as phenyloxycarbonyl, xylyloxycarbonyl, tolyloxycarbonyl, mesityloxycarbonyl, etc.), alkylsulfonamide (such as methylsulfonamide, ehtylsulfonamide, butylsulfonamide, bezylsulfonamide, etc.), arylsulfonamide (such as phenylsulfonamide, xylylsulfonamnide, tolylsulfonamide, mesitylsulfonamide, etc.), alkylcarbonyloxy (such as ethylcarbonyloxy, etc.), aryloxycarbonyl (such as benzoyloxy, etc.), and aminosulfonamide groups (such as N,N-dimethylaminosulfonamide group, etc.). Two or more of these substituents may be introduced into the phenyl group. Substituents on alkyl group include similarly those as described above. Preferred groups designated by $R_9$ include unsubstituted phenyl groups or phenyl groups containing alkyl, alkylsulfonamide, alkoxy, alkylsulfamoyl, aminosulfonamide, alkyloxycarbonyl or aryloxycarbonyl group as the substituents thereof.

Groups designated by $R_9$ also include groups forming a 5 or 6-membered ring condensed to their phenolic rings by bonding $R_2$ with $R_3$ in Formula [I], such as a group forming carbostyryl or 3,4-dihydrocarbostyryl.

Groups designated by Z in Formula [I], which is releasable through the coupling reaction with the oxidation product of an aromatic primary amine color developing agent are well known to those skilled in the art and which improve the reactivity of a coupler, or advantageously action to be released from the coupler so as to fulfill their functions of development inhibition, bleaching inhibition and color correction on a coated layer on the other layers of a silver halide color photographic light-sensitive material, containing the coupler. Typical examples of such groups are a halogen (such as fluorine, chlorine and bromine), and alkoxy (such as methoxy, ethoxy and octoxy), aryloxy (such as phenyloxy), cyclohexyloxy, arylazo (such as phenylazo), and thioether (such as benzylthio) group as well as hetrocyclic groups (such as oxazolyl, diazolyl, triazolyl and tetrzolyl groups), and aralkylcarbonyloxy group. Particularly suitable groups designated by Z are hydrogen, a halogen (preferably, chlorine), and alkoxy and aryloxy groups.

Particularly preferred cyan couplers represented by Formula [I] are compounds designated by the following Formula [IV]:

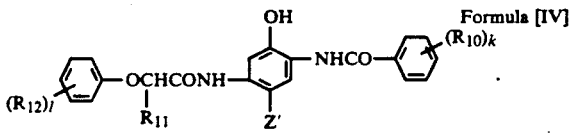

Formula [IV]

wherein $R_{10}$ represents a halogen (such as chlorine and fluorine), alkylsulfonamide (such as methanesulfonamide and ethanesulfonamide), arylsulfonamide (such as benzenesulfonamide), alkylsulfamoyl (such as methylsulfamoyl and ethylsulfamoyl), arylsulfamoyl (such as phenylsulfamoyl), cyano, alkyloxycarbonyl (such as methoxycarbonyl and ethoxycarbonyl), aryloxycarbonyl (such as phenoxycarbonyl), and alkyl groups (such as methyl, ethyl, t-butyl, dodecyl, octadecyl, benzyl, phenethyl, trifluoromethyl and pentafluoroethyl).

$R_{11}$ represents straight or branched alkyl groups (such as methyl, ehtyl, t-butyl, n-butyl and n-dodecyl groups), and preferably, straight or branched alkyl groups containing 1 to 20 carbon atoms.

$R_{12}$ designates straight or branched alkyl groups (such as methyl, ethyl, n-butyl, t-amyl, n-pentyl, n-octyl and n-dodecyl groups), alkylsulfonamide (such as methylsulfonamide, ethylsulfonamide, butylsulfonamide and benzylsulfonamide), alkylsulfamoyl (such as butylsulfamoyl and octylsulfamoyl), alkoxy (such as methoxy, ethoxy, butoxy and octoxy), alkylaminosulfonamide (such as N,N-dmethylaminosulfonamide and N-methylaminosulfonamide), alkyloxycarbonyl (such as ethoxycarbonyl and butoxycarbonyl) and aryloxycarbonyl (such as phenoxycarbonyl) groups.

Z' designate hydrogen and halogen (such as chlorine and fluorine) atoms, and k and l are an integer of 0 to 5, respectively.

Typical specified examples of cyan couplers designated by Formula [I] according to the present invention are as follows and are intended not to be limited thereto.
(I-1)
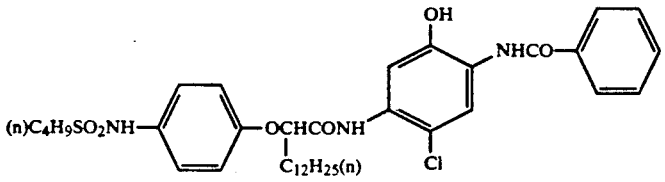
(I-2)
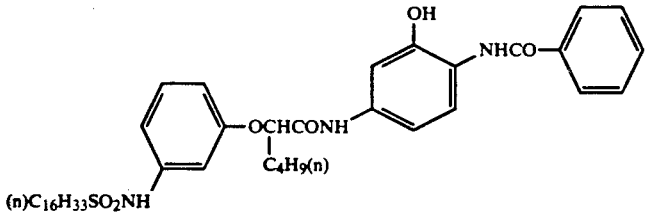
(I-3)
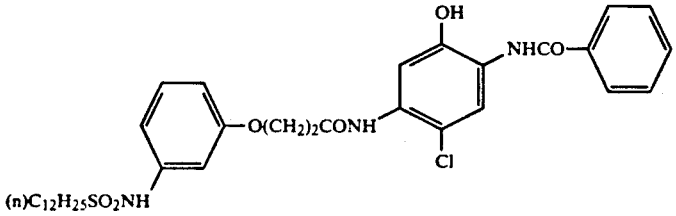
(I-4)
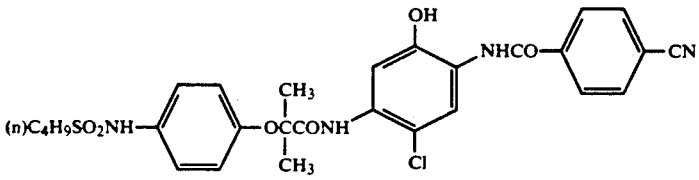
(I-5)
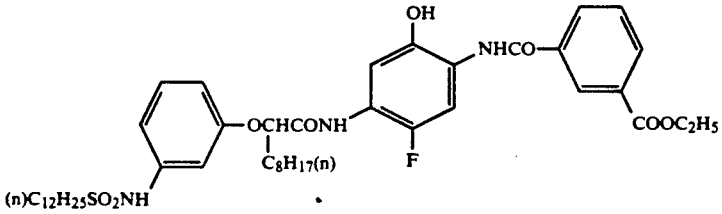
(I-6)
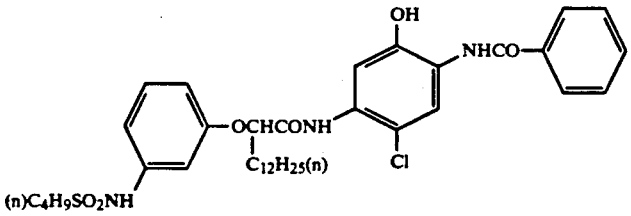
(I-7)
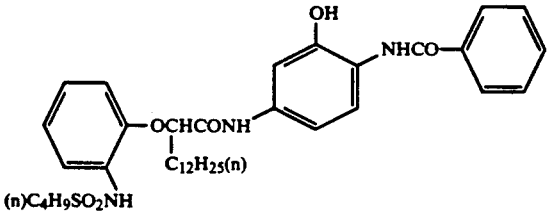

-continued
(I-8)
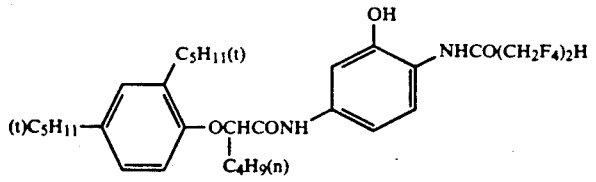
(I-9)
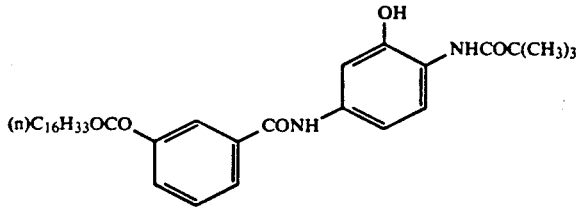
(I-10)
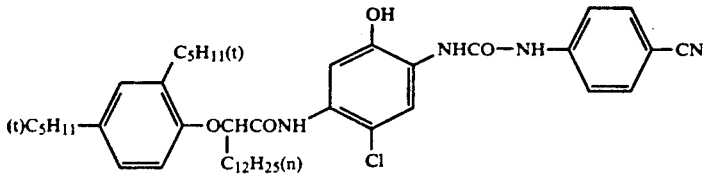
(I-11)
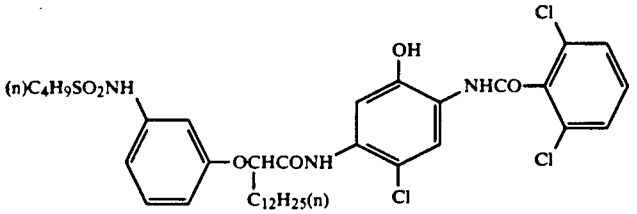
(I-12)
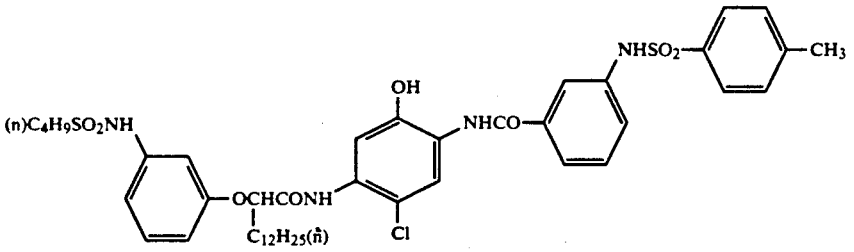
(I-13)
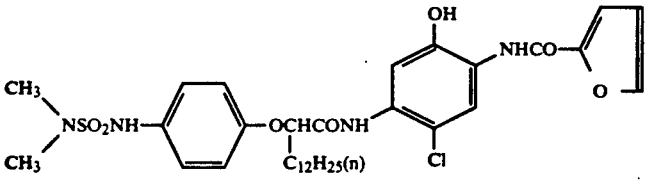
(I-14)
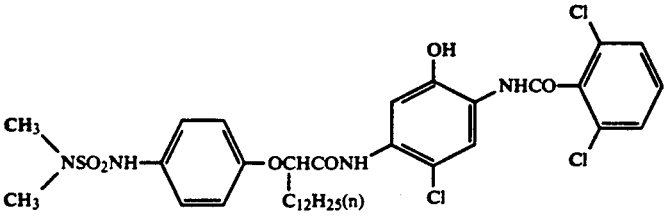

-continued
(I-15)
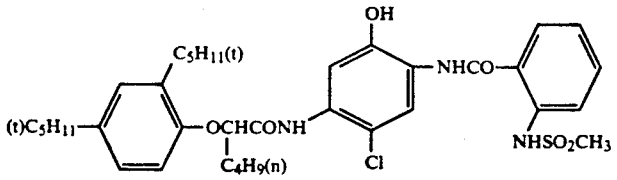
(I-16)
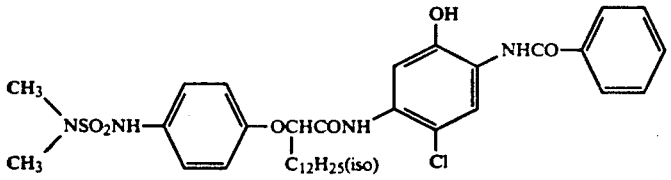
(I-17)
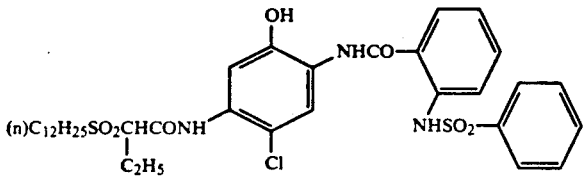
(I-18)
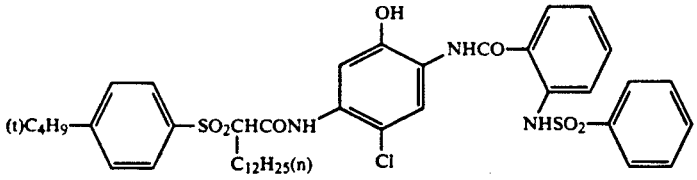
(I-19)
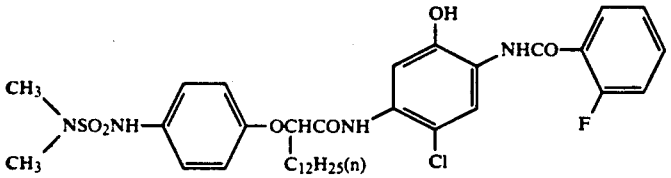
(I-20)
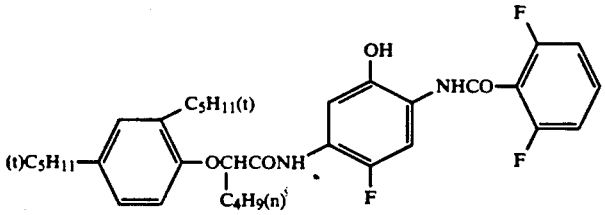
(I-21)
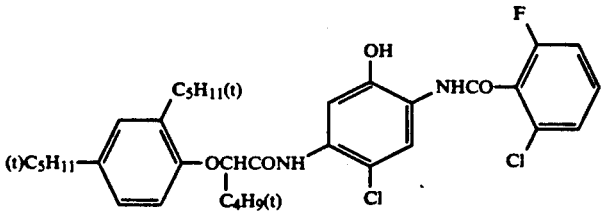
(I-22)
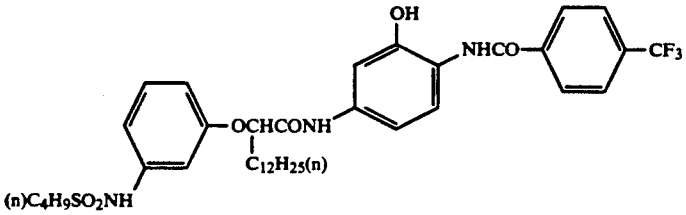

-continued
(I-23)
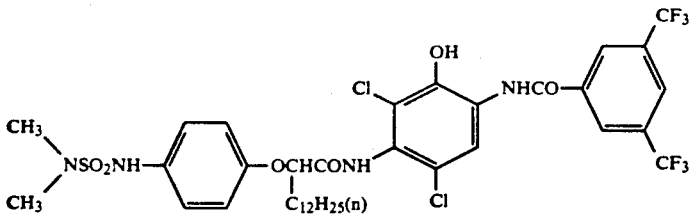
(I-24)
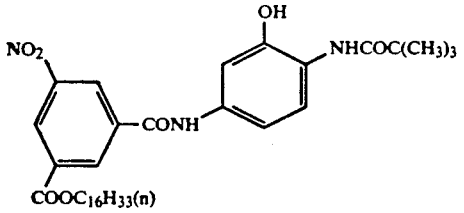
(I-25)
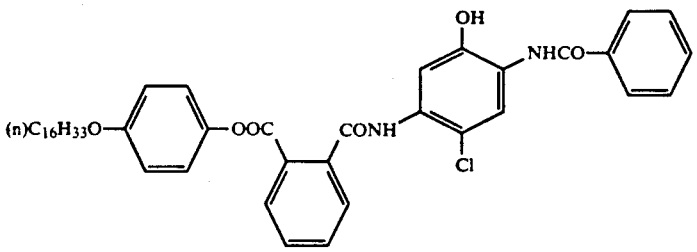
(I-26)
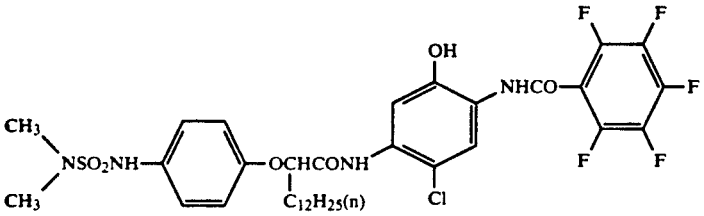
(I-27)
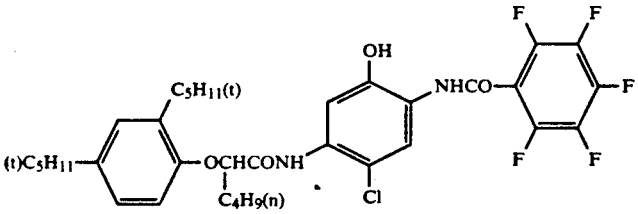
(I-28)
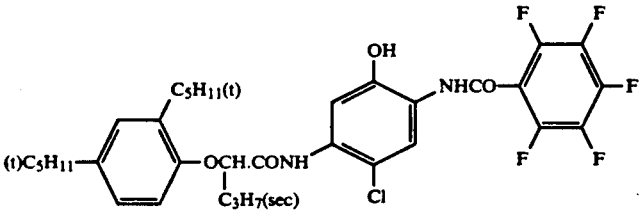
(I-29)
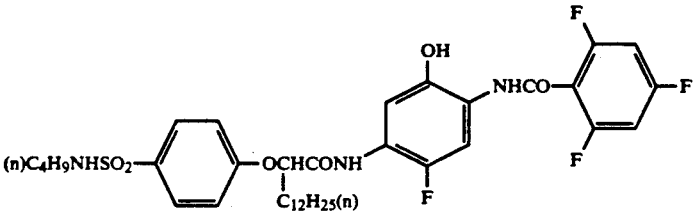

-continued
(I-30)
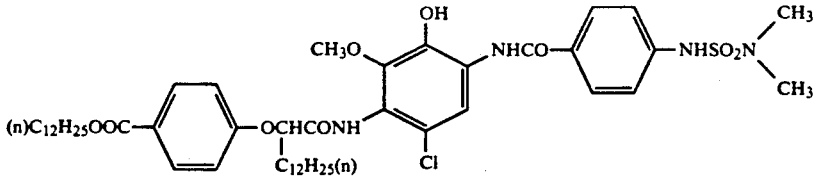
(I-31)
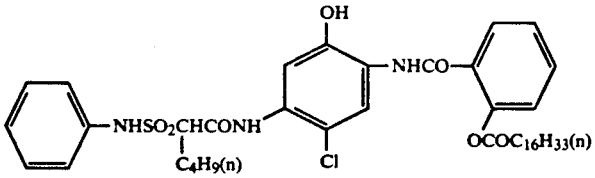
(I-32)
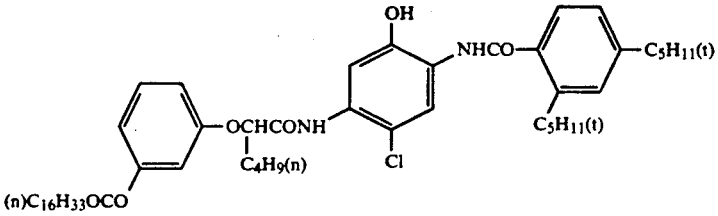
(I-33)
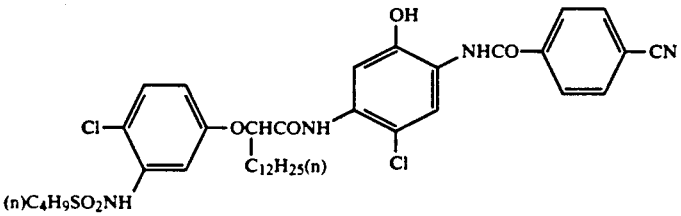
(I-34)
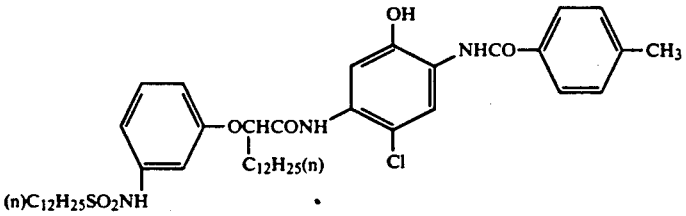
(I-35)
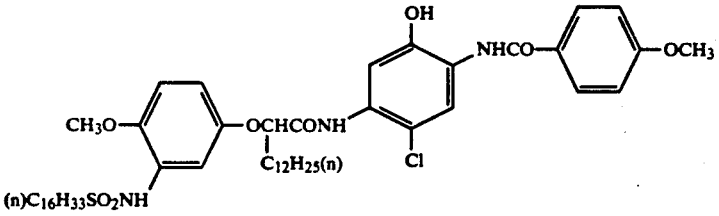
(I-36)
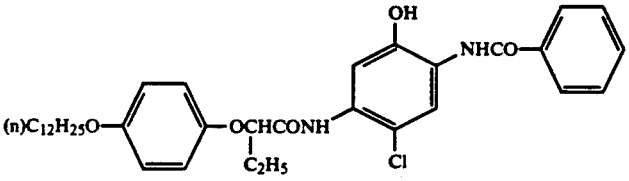

-continued (I-37)

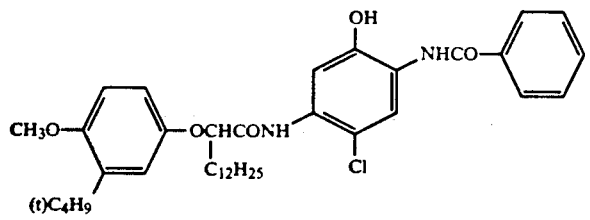

(I-38)

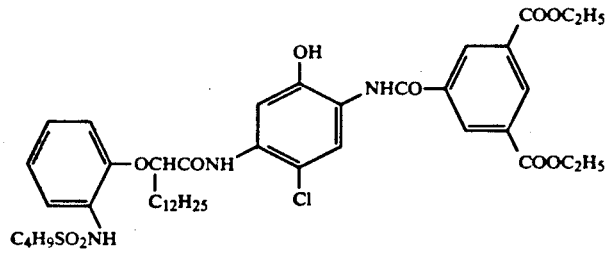

(I-39)

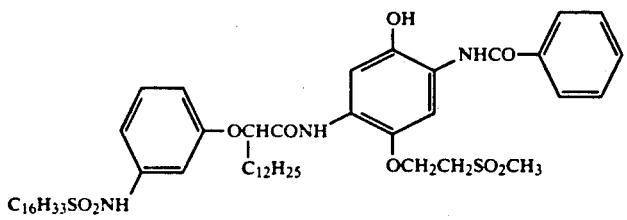

(I-40)

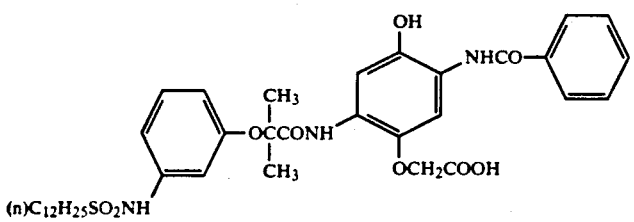

(I-41)

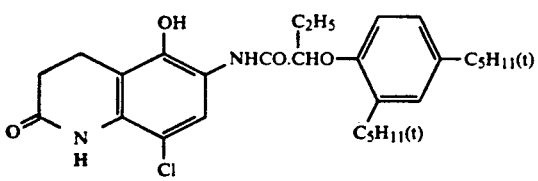

A cyan coupler represented by Formula [I] given hereinbefore (hereinafter referred to as cyan coupler according to the present invention) and hydrophobic additives such as an ultraviolet absorbent for a magenta coupler or a yellow coupler or the like are incorporated into a silver halide emulsion layer or a non-light-sensitive layer after being dispersed in an aqueous solution of hydrophilic binder in a known process. The processes for dispersing these hydrophobic compounds include a latex dispersion process or an oil drop-in-water type dispersion process, for example, as described in Japanese Patent O.P.I. Publication Nos. 74538/1974, 59943/1976 and 32552/1979, and Research Disclosure No. 14850, 77-79, August, 1976. Oil drop-in-water type dispersion processes include a conventional process for dispersing hydrophobic compounds such as couplers or the like. Specifically, the process comprises dissolving a hydrophobic compound in a high boiling organic solvent having a boiling point of 175° C. or more which, if required, contains a low boiling solvent added thereto such as ethyl acetate, butyl acetate, etc., mixing the resulting solution with an aqueous solution of a hydrophilic binder such as a gelatin containing a surfactant, emulsifying and dispersing the resulting mixture by a dispersing means such as a high speed rotary mixer, colloid mill, ultrasonic dispersing device or the like, and then incorporating the resulting emulsion into a hydrophilic colloidal layer such as a silver halide emulsion layer or a non-light-sensitive layer. The high boiling organic solvents which can be employed in the aforesaid process include one or more, alone or in combination, or organic acid amides, carbamates, esters, ketones and urea derivatives, and particularly, phthalate esters such as dimethyl phthalate, diethylphthalate, dipropyl phthalate, dibutyl phthalate, di-n-octyl phthalate, diisooctyl phthalate, diamylphthalate, dinonyl phthalate and di-isodecyl phthalate; phosphoric esters such as tricresyl phosphate, triphenyl phosphate, tri-(2-ethylhexyl)phosphate, and tri-isononyl phosphate; sebacic esters such as dioctyl sebacate, di-(2-ethylhexyl)sebacate and di-isodecyl sebacate; esters of glycerol such as glycerol tripropionate and glycerol tributylate; and in addition, other esters such as adipic, glutaric, succinic, maleic, fumaric and citric esters; and phenol derivatives such as di-tert-amylphenol and n-octylphenol.

One or more cyan couplers according to the present invention may be employed alone or in combination, but may be combined with other cyan couplers if required. In applying the cyan coupler according to the present invention in a color light-sensitive material, it may be incorporated into any of blue, green and red-sensitive emulsion layers, but preferably, is usually incorporated into the red-sensitive emulsion layer in an amount within a range of 0.1 to 1 mole per mole of a silver halide.

The description will be made of compounds represented by Formula [II]. Alkyl groups designated by $R_4$ and $R_5$ in Formula [II] in the present invention are straight or branched alkyl groups containing 1 to 10 carbon atoms, and may be substituted with sulfonic acid group or carboxy group, including methyl, ethyl, propyl, iso-propyl or butyl group, for example. Similarly, aryl groups denoted by $R_4$ and $R_5$ may be substituted with sulfonic acid group, carboxy group or the like, and include phenyl, sulfophenyl or other group, for example.

Likewise, R' and R'' in groups of —COOR' —OR', —NR'R'', —NHCOR', —NHCONHR' and —CONHR' are straight or branched alkyl or aryl groups containing 1 to 10 carbons atoms. Such alkyl groups may be substituted with sulfonic acid group or carboxy group and include methyl, ethyl, propyl or iso-propyl group, for example. Such aryl groups may also be substituted with sulfonic acid group or carboxy group and include phenyl or sulfophenyl group, for example.

Alkyl groups designated by $R_6$ and $R_7$ and containing at least one carboxy group or sulfonic acid group are sulfomethyl, carboxymethyl, sulfoethyl, carboxyethyl, sulfopropyl, carboxypropyl, disulfobutyl or dicarboxybutyl group, for example, and aryl groups denoted by $R_6$ and $R_7$ and containing at least one carboxy group or sulfonic acid group are sulfophenyl, disulfophenyl, trisulfophenyl, sulfo-caroxyphenyl, carboxyphenyl or dicarboxyphenyl group.

$R_4$ and $R_5$ in Formula [II] in the present invention are preferably groups designated by —COOR' wherein R' is preferably hydrogen or a straight or branched alkyl group containing 1 to 10 carbon atoms.

$R_6$ and $R_7$ in Formula [II] in the present invention are preferably a phenyl group containing at least one sulfonic acid group, and more preferably a pheny group containing two or more sulfonic acid groups.

In the present invention, the compounds designated by Formula [II] are preferably those represented by the following Formula [V]:

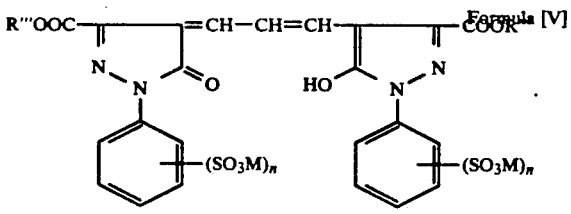

wherein R''' is hydrogen or an alkyl group (such as methyl, ethyl or propyl group), n is an integer of from 2 to 5, and M represents hydrogen or a monovalent metal atom (such as sodium or potassium atom).

In the present invention, a compound represented by Formula [II] is generally dissolved in water or an alcohol and then incorporated into a silver halide containing layer and/or a non-light-sensitive layer in an amount within a range of 0.01 to 1 mg per 100 $cm^2$.

The compounds represented by Formula [II] are normally added into a green light-sensitive silver halide emulsion layer, and the same effect may be obtained even when adding it into other layers.

The following are typical specified examples of dyes relating to the present invention, represented by Formula [II] but such dyes are not intended to be limited thereto.

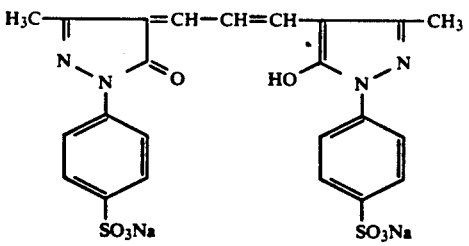

(II-1)

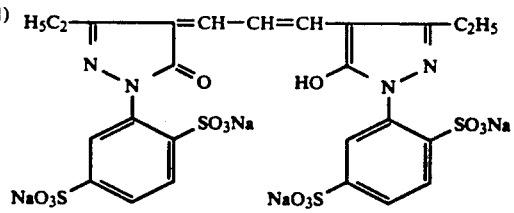

(II-2)

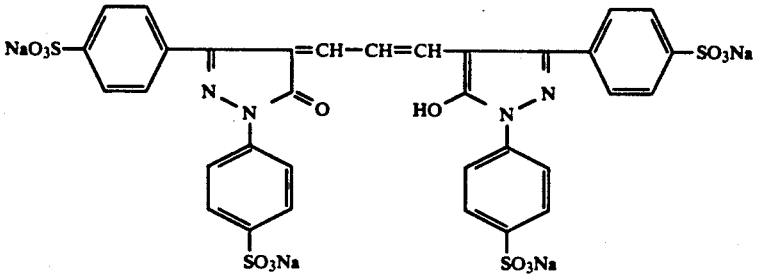

(II-3)

-continued
(II-4)
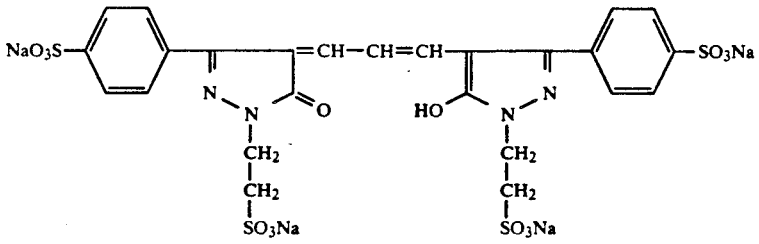
(II-5)
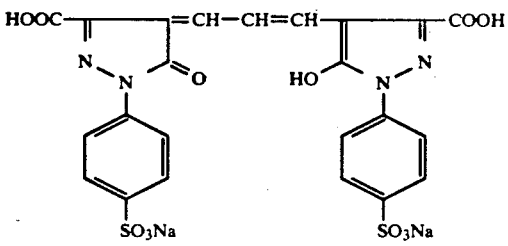
(II-6)
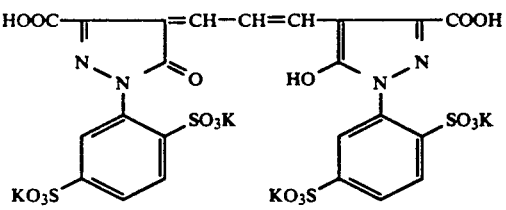
(II-7)
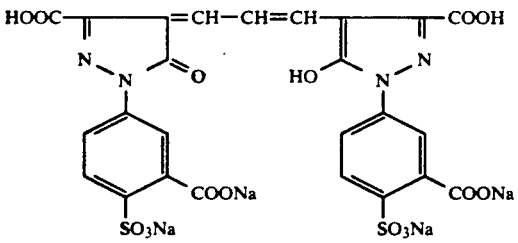
(II-8)
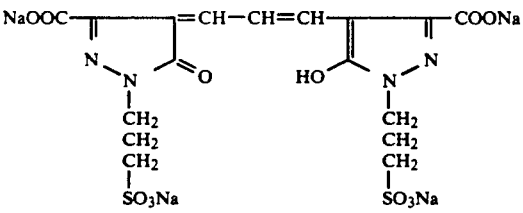
(II-9)
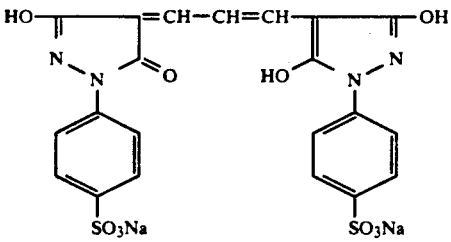
(II-10)
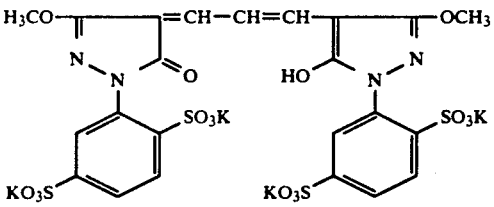
(II-11)
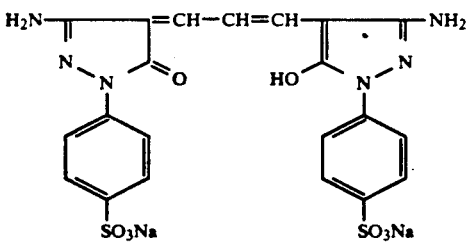
(II-12)
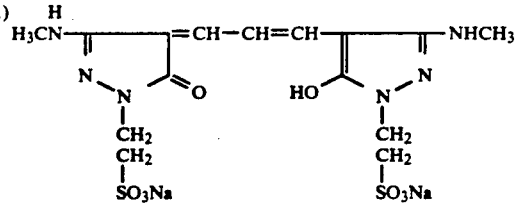
(II-13)
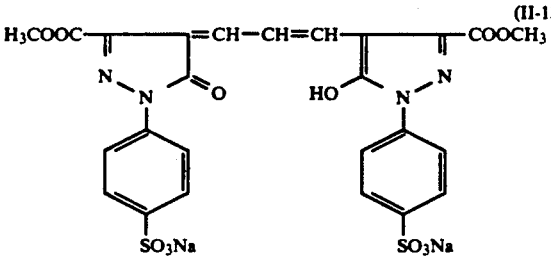
(II-14)
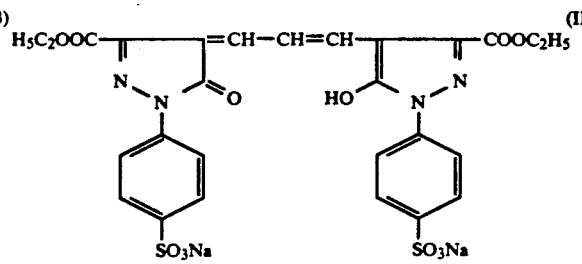

-continued (II-15)

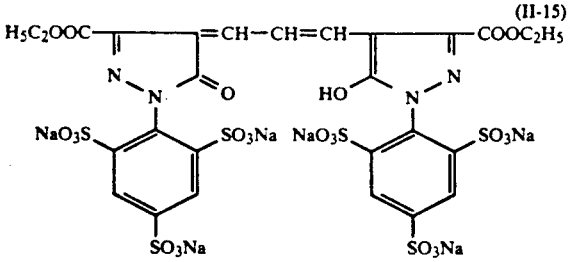

(II-16)

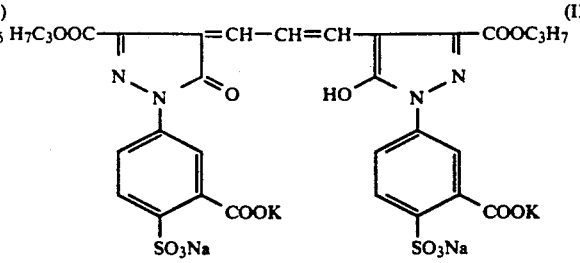

(II-17)

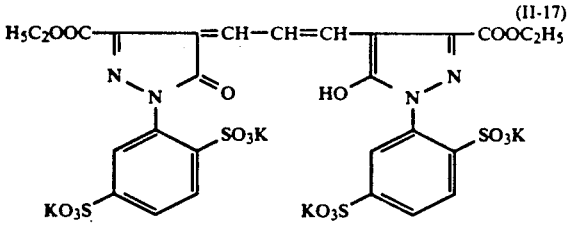

(II-18)

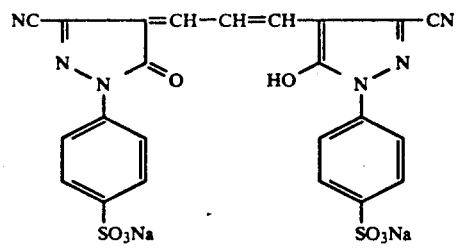

(II-19)

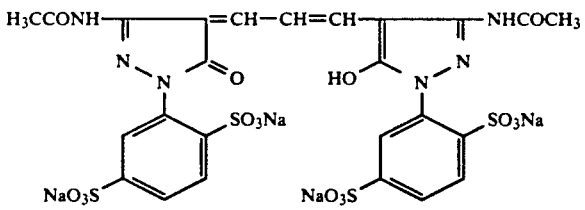

(II-20)

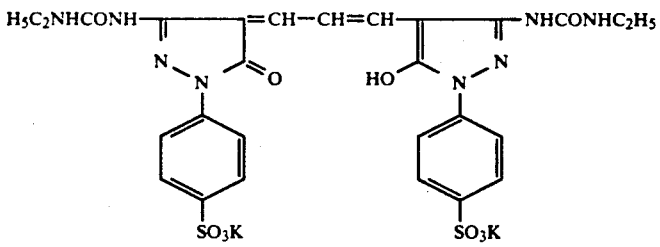

(II-21)

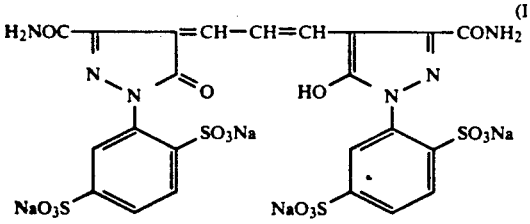

(II-22)

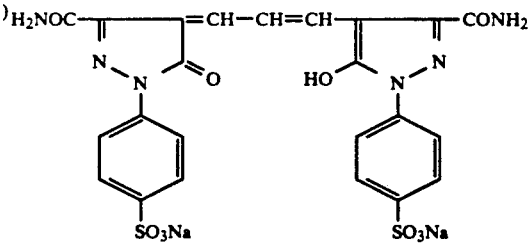

(II-23)

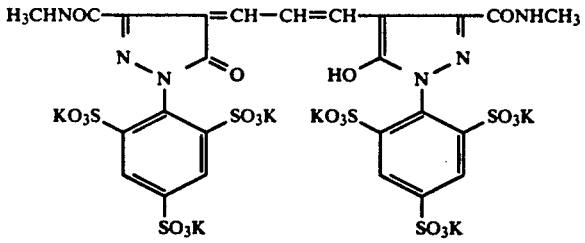

In the application of the present invention to a color light-sensitive material, conventionally-known magenta and yellow couplers are employed together with a coupler according to the present invention and particularly, 3-anilino-5-pyrazolone type magenta coupler and pivaloyl-acetoamide type yellow coupler are preferably used.

These magenta and yellow couplers are usually contained in a silver halide emulsion layer in an amount within a range of 0.01 to 2 moles, preferably 0.1 to 1.0 mole per mole of the silver halide, respectively.

Silver halides used in a silver halide emulsion relating to the present invention include any of those used in a normal silver halide emulsion, such as silver bromide, silver chlorobromide, silver chloroiodobromide emulsions or the like. The grains of these silver halides may be coarse or fine, and the grain sizes thereof may be distributed into a narrower or wider range.

In addition, the crystals of these silver halide grains may be normal or twin, and can have any of ratios of [1 0 0] plane to [1 1 1] plane. The crystal structure of these silver halide grains may be uniform throughout from the inner portion to the outer portion or may be different in layer structure between the inner and outer portions. These silver halides may be of a type forming a latent imge primarily on the surface or of a type forming a latent image in the interior of the grain. Further, these silver halides may be produced in any of neutral, ammonia and acidic processes and also in any of double-jet, normal, reverse processes or conversion processes.

Although it is preferable to use a silver halide emulsion obtained by removing soluble salts therefrom in a silver halide color photographic light-sensitive material according to the present invention, it is possible to use a silver halide emulsion containing unremoved soluble salts. Two or more silver halide emulsions separately prepared can be used in mixture.

A silver halide photographic emulsion obtained by dispersing silver halide grains in a binder solution can be sensitized with a chemical sensitizer. Such chemical sensitizers which can be advantageously used in the present invention are classified broadly into four groups: a group of noble metal sensitizers, a group of sulfur sensitizers, a group of selenium sensitizers and a group of reduction sensitizers.

Noble metal sensitizers which can be employed include gold compounds as well as rutenium rhodium, palladium, iridium or platinum compounds or the like.

When gold compound is used, ammonium thiocyanate or sodium thiocyanate can be also used together.

Sulfur sensitizers which can be used include active gelatins and in addition, sulfur compounds.

Selenium sensitizers which can be used include active or inert selenium compounds.

Among reduction sensitizers are included monovalent tin salts, polyamines, bis-alkylaminosulfides, silane compounds, iminoaminomethane sulfinic acid, hydrazinium salts and hydrazine derivatives.

A silver halide relating to the present invention is spectrally sensitized in accordance with the selection of a suitable sensitizing color dye in order to provide a sensitivity in a region of sensitive wavelength required for a red-sensitive emulsion. Various spectrally sensitizing color dyes can be used and in practice, one or more such spectrally-sensitizing color dyes may be employed alone or in combination.

Binders used for component layers of a silver halide photographic light-sensitive material according to the present invention are most commonly gelatins such as alkali- or acid-treated gelatins, but along with a part of such a gelatin, the following compounds can also be used in combination: derivative gelatins such as phthalated gelatin, and phenylcarbamoyl gelatin; albumine, agar, gum arabic, alginic acid, partially-hydrolyzed cellulose derivatives, partially-hydrolyzed polyvinyl acetate, polyacrylamide, polyvinylalcohol, polyvinyl pyrrolidone and copolymers of these vinyl compounds.

Various other photographic additives can be incorporated in the emulsion layers and auxiliary layers of a light-sensitive material according to the present invention. For example, the following additives can be properly used: an anti-fogging agent, an anti-fading agent for color dye image, an anti-color-contamination agent, an optical brightening agent, antistatic agent, a hardener, a surfactant, a plasticizer, a wetting agent and an ultraviolet absorbent, as described in Research Disclosure No. 17,643.

A silver halide photographic light-sensitive material according to the present invention is made by applying individual component layers such as an emulsion layer and an auxiliary layer which, if required, contain various photographic additives incorporated thereinto as discussed above, onto a support directly or through a subbing layer and/or an inter layer, which support has been subjected to a corona discharge treatment, a flame treatment or an ultraviolet irradiation treatment. Examples of supports which can be advantageously used are and barayta paper, polyethylene-coated paper, polyproylene synthetic paper and transparent or clear supports formed thereon with reflecting layer or reflector, including glass plates, films of polyesters such as cellulose acetate, cellulose nitrate and polyethylene terephthalate, and films of polyamides, polycarbonates and polystyrenes, for example. These supports are appropriately selected respectively according to the purposes of using light-sensitive materials.

The application of the emulsion layers and other component layers used in the present invention can be accomplished by various coating processes such as dipping, air-doctor, curtain, and hopper coating processes. The simultaneous application of two or more layers can be conducted in the processes as described in U.S. Pat. Nos. 2,761,791 and 2,941,898.

According to the present invention, individual emulsion layers may be formed in any arrangement, and for example, an arrangement can be used of the blue, green and red-sensitive emulsion layers, or of the red, green and blue-sensitive emulsion layers, in the order from the support side.

In these component layers, the hydrophilic colloids capable of being employed in the emulsions as described above can be similarly used as a binder, and various photographic additives capable of being contained in the emulsion layers as discussed hereinbefore can be likewise incorporated into the component layers. An ultraviolet absorbent layer can be formed on a layer adjacent to the emulsion layer farthest away from and on the side of the support, and an ultraviolet absorbent layer can be also formed as required on a layer on the opposite side of the support. Particularly, in the latter case, it is preferable to form a protective layer consisting substantially of only a gelatine on the uppermost layer.

When the present invention is applied to a color light-sensitive printing material, the light-sensitive material is exposed to light through a negative light-sensitive material bearing an image made of a coupling product, and then subjected to a color development.

The color development is conducted in a usual color development process.

Specifically, the exposed light-sensitive material is first treated with a color developer solution containing a color developing agent. Alternatively, the light-sensitive material which has contained a color developing agent or its precursor is treated with an activator.

Then, the steps of bleaching and fixing the resulting material are conducted in a usual manner.

In this case, the color development step using a color developer or an activator, bleaching step and fixing step may often conducted independently, but otherwise, can be carried out at a time (in a single bath) using a treating solution having those functions, instead. For example, the latter case include a method using a single bath comprising a color developer solution or activator solution containing a bleaching or fixing agent together as will be described hereinafter, a method using a bleach-fix bath containing bleaching and fixing agents for effecting the bleaching and fixing operation after the color development, and the like.

In addition, the exposed light-sensitive material can be treated in a bleach-fix bath immediately after the treatment with a color developer solution or an activator solution, thereby to remove a silver, but an acidic stop bath can be provided between the color developing and bleach-fix steps. An aqueous acetic or citric acid solution can be used in such an acidic stop bath. If necessary, it is possible to further provide a prehardening step and steps for the neutralization thereof, washing, and stabilization.

Such color developments produce the color dye images by coupling reactions on the color light-sensitive printing material.

Color developing agents for the light-sensitive materials according to the present invention are representatively of aromatic primary amines.

Included among color developing agents of aromatic primary amines are aminophenol or p-phenylenediamine derivatives which can be used in the free state or in the form of the hydrochloride or sulfate thereof, or the organic acid salts thereof such as p-toluene sulfonate, tetraphenyl borate and p-(t-octyl) benzene sulfonate.

Examples of typical color developing agents of aromatic primary amines are o-aminophenol, p-aminophenol, 5-amino-2-oxytoluene, 2-amino-3-oxytoluene, 2-oxy-3-amino-1,4-dimethylbenzene, N,N-dimethyl-p-phenylenediamine hydrochloride, N-methyl-p-phenylenediamine hydrochloride N,N-dimethyl-p-phenylenediamine hydrochloride, N-ethyl-N-β-methanesulfonaminoethyl-3-methyl-4-aminoaniline and the sulfate thereof, N-ethyl-N-β-hydroxyethylaminoaniline, N,N-diethyl-3-(β-methanesulfonamidethyl)-4-aminoaniline hydrochloride, 4-amino-N-(2-methoxyethyl)-N-ethyl-3-methylaniline-p-toluene sulfonate, N-ethyl-N-β-methanesulfonamidethyl-3-methyl-4-aminoaniline tetraphenyl borate, 4-amino-N-(2-methoxyethyl)-N-ethyl-3-methylaniline.tetraphenyl borate, p-morpholinoaniline, p-piperidino-aniline, 4-amino-N,N-diethyl-3-chloroaniline.

Moreover, if required, a precursor of a color developing agent may be contained in the light-sensitive materials of the present invention. The precursors of color developing agents are compounds capable of producing a color developing agent under an alkaline condition, and include those of aromatic aldehyde derivative-Schiff base type, polyvalent metal ion complex, phthalicimide derivative, amide phosphate derivative, sugar amine reactant and urethane type.

These precursors of aromatic primary amine type color developing agents are described, for example, in U.S. Pat. Nos. 3,342,599; 2,507,114; 2,695,234; and 3,719,492, British Patent No. 803,783, Japanese Patent O.P.I. Publication Nos. 135628/1978 and 79035/1979, and Research Disclosure Nos. 15159; 12146 and 13924.

These color developing agents of aromatic primary amines are usually contained in a color developer solution, in the amount of the order of 1 to 20 g/l. When such a developer is incorporated in the form of a precursor into the light-sensitive material, it is contained in the amount of the order of 0.5 to 3 moles per mole of a silver halide.

A water-soluble optical brightening agent may be added in the order of 0.1 to 10 g/l into a color developer or activator solution used for the light-sensitive material of the present invention.

The color developer or activator solutions used for the light-sensitive material of the present invention are those containing alkaline materials such as potassium hydroxide, sodium hydroxide, sodium carbonate, potassium carbonate, sodium tertiary phosphate, potassium tertiary phosphate; sulfites such as sodium and potassium sulfites; and fluorides such as sodium, potassium and ammonium fluorides. Further, they may contain, as required, known development inhibitors, thiocynates such as sodium, potassium and ammonium thiocyanates; chlorides such as ammonium, potassium and sodium chlorides; organic solvents such as ethylene glycol, diethylene glycol, methanol, ethanol, n-butanol, benzyl alcohol, acetone and dimethyl formamide; amines such as hydroxyamine, ethanolamine, ethylenediamine and diethanolamine; water softeners such as sodium hexamethaphosphate, tripolyphosphate, ethylenediamine tetraacetate and diethylenetriamine pentaacetate.

An auxiliary developer may be incorporated into the color developer or activator solution used in the present invention. Such preferred auxiliary developers are 1-aryl-3-pyrazolidone derivatives and are used in an amount within a range of 1 mg to 1 g, preferably 10 mg to 500 mg per liter of the color developer or activator solution. Representatives of auxiliary developers are 1-phenyl-3-pyrazolidone, 4-methyl-1-phenyl-3-pyrazolidone, 4,4-dimethyl-1-phenyl-3-pyrazolidone, 4-methyl-4-hydroxymethyl-1-phenyl-3-pyrazolidone, 4-methyl-4-hydroxymethyl-1-(p-tolyl)-3-pyrazolidone.

The color developer or activator solution used in the present invention is kept alkaline and its hydroxide ion concentration is generally at a pH of 9.5 to 13.5, but can be suitably selected depending upon the type, composition, object and application of the negative light-sensitive material or color light-sensitive printing material.

The color developer or activator solution used in the present invention is generally used at a temperature within a certain range and preferable within a range of 15° C. to 70° C., and more preferably of 30° C. to 50° C., depending upon the type, composition, application and purpose of a color light-sensitive printing material to be treated and according to the present invention.

Bleaching agents which can be employed in a bleaching bath or a bleaching-fix bath may be known compounds and include salts of aminopolycarboxylic ferric complexes such as sodium or ammonium salts of ethylenediamine tetraacetate ferric complex, and persulfates such as ammonium or sodium persulfates, for example. Fixing agents which can be used in a fixing bath or a bleach-fix bath may also be known compounds and include thiosulfates such as sodium or ammonium thiosulfates, water-soluble sulfur-containing diols such as 3,6-dithia-1,8-octanediol and 3,6,9,12-tetrathia-1,14-tetradecanediol, and water-soluble sulfur-containing dibasic acids such ethylene-bis-thioglycolic acid and the sodium salts thereof.

EFFECTS OF THE INVENTION

The application of the present invention to a color light-sensitive printing material enables a print having an excellent dark keeping property, sharpness and whiteness to be obtained and a print matched to needs of end users to be provided, and further enables a color light-sensitive printing material having an excellent latent image stability to be provided and a working efficiency in a laboratory to be substantially improved.

EXAMPLES

The present invention will now be described by way of Examples, but is not intended to be limited in any way to the illustrative Examples.

EXAMPLE 1

A color light-sensitive printing material was made in a manner as described in the following item (1). This sample was exposed imagewise and then treated with a color developer solution and a bleach-fix solution which will be described hereinbelow to determine the characteristics of the individual color dye images formed.

(1) Preparation of Sample

A paper support covered over with a polyethylene containing anatase-type titanium dioxide as a white pigment was pretreated by subbing a gelatin, and the following layers were coated on the pretreated support in turn to prepare a sample.

Layer 1: a blue-sensitive silver chlorobromide emulsion layer.

This layer was applied using an emulsified dispersion prepared by dissolving in dioctyl phthalate silver chlorobromide containing 5 mole % of silver chloride as well as a yellow coupler (Y-1) which will be described hereinbelow and 2,5-di-tert-octylhydroquinone.

Layer 2: a first interlayer.

This layer was formed using an emulsified dispersion produced by dissolving 2,5-di-tert-octylhydroquinone in dioctyl phthalate.

Layer 3: a green-sensitive silver chlorobromide emulsion layer.

This layer was formed by use of the mixture of an aqueous solution of a dye given in Table II with an emulsified dispersion made by dissolving in dioctyl phthalate silver chlorobromide containing 15 mole % of silver chloride, as well as a magenta coupler (M-1) to be described hereinafter and 2,5-di-tert-octyhydroquinone.

Layer 4: a second interlayer.

This layer was formed of mixture of an emulsified dispersion obtained by dissolving in dioctyl phthalate an ultraviolet absorbent (UV-1) to be described and 2,5-di-tert-octylhydroquinone, with an aqueous solution of a dye given in Table II.

Layer 5: a red-sensitive silver chlorobromide emulsion layer.

This layer was formed using an emulsified dispersion resulting from the dissolving, in dioctyl phthalate, of silver chlorobromide emulsion containing 25 mole % of silver chloride, as well as a cyan coupler given in Table II and 2,5-di-tert-octylhydroquinone.

Layer 6: a protective layer.

This layer is formed by use of a mixture consisting essentially of a gelatin and a hardener.

(Y-1)

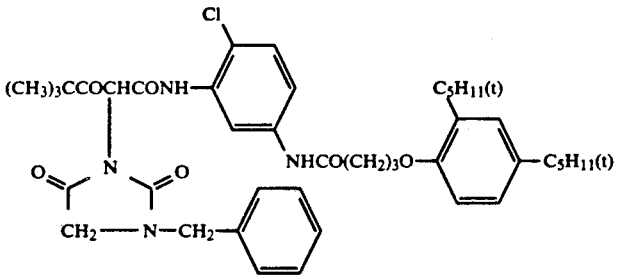

(M-1)

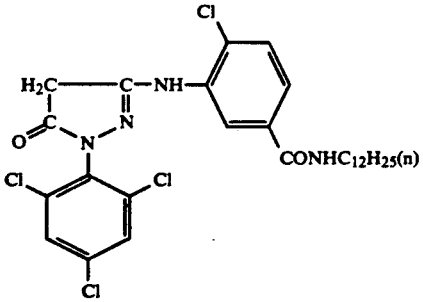

(C-1)

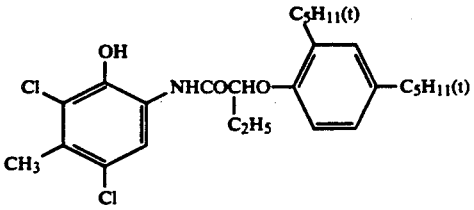

-continued

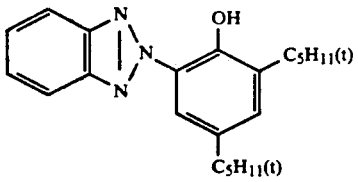

(UV-1)

The respective amounts of components in each the layers are given in Table I.

TABLE I

| Layer | Silver halide emulsion | Ultraviolet absorbent coupler | 2,5-di-tert-octylhydro-quinone | Gelatin |
|---|---|---|---|---|
| Layer 1 | 3 mg* in terms of silver | (Y-1) 8 mg | 0.5 mg | 20 mg |
| Layer 2 | Interlayer | — | 1.0 mg | 10 mg |
| Layer 3 | 4 mg** in terms of silver | (M-1) 5 mg | 0.5 mg | 15 mg |
| Layer 4 | Interlayer | (UV-1) 6 mg | 1.0 mg | 10 mg |
| Layer 5 | 3 mg*** in terms of silver | 4 mg**** | 0.5 mg | 15 mg |
| Layer 6 | Protective layer | — | — | 10 mg |

*A blue-sensitive silver chlorobromide emulsion
**A green-sensitive silver chlorobromide emulsion
***A red-sensitive silver chlorobromide emulsion
****A coupler given in Table II On the basis of the above arrangement of layers, ten samples given in Table II were prepared by altering the cyan coupler in the red-sensitive silver chlorobromide emulsion and the dyes in the green-sensitive silver chlorobromide emulsion layer and layer 4(interlayer), respectively.

TABLE II

| Sample | Green-sensitive silver chloro-bromide emulsion layer dye (mg/100 cm²) | Interlayer (layer 4) dye (mg/100 cm²) | Red-sensitive chlorobromide emulsion layer cyan coupler (mg/100 cm²) |
|---|---|---|---|
| 1 | — | — | Illustration I-28 4 |
| 2* | Illustration II-6 0.08 | — | the same as above 4 |
| 3* | Illustration II-6 0.16 | — | the same as above 4 |
| 4* | — | Illustration II-6 0.08 | the same as above 4 |
| 5 | — | Control A-1 0.08 | the same as above 4 |
| 6 | Control A-1 0.08 | — | the same as above 4 |
| 7 | Illustration II-6 0.08 | — | Control C-1 4 |
| 8 | — | Illustration II-6 0.08 | the same as above 4 |
| 9* | Illustration II-15 0.08 | — | Illustration I-41 4 |
| 10* | Illustration II-5 0.08 | — | Illustration I-14 4 |

*A sample according to the present invention.
Each of nurmerals in Table II denotes the application amount per 100 cm².

Control (comparative compound)

-continued

A-1

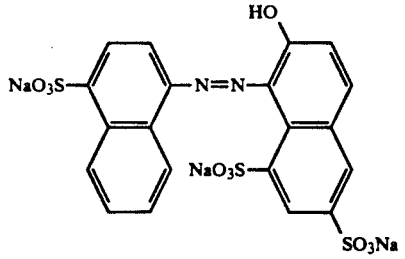

The ten samples prepared in this manner were evaluated in fogginess and latent image stability.

1) Fogginess

The unexposed samples were subjected to the following treatments, and then determined in red density using Greterk D-122 type desitometer.

| Treating step (32.8° C.) | Treating time |
|---|---|
| Color developing | 3 minutes and 30 seconds |
| Bleach-fixing | 1 minute and 30 seconds |
| Washing | 3 minutes and 30 seconds |
| Drying | 1 minutes |

| Composition of color developer solution | |
|---|---|
| N-ethyl-N-β-methanesulfonamideethyl-3-methyl-4-aminoaniline sulfate | 4.0 g |
| Hydroxyamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 g |
| Polyethylene glycol (average polymerization degree of 400) | 3.0 ml |
| Water is added to make one liter, and to adjust a pH to 10.0 with sodium hydroxide. | |

| Composition of bleach-fixing solution | |
|---|---|
| Sodium salt of ethylenediamine tetraacetato iron | 60.0 g |
| Ammonium thiosulfate | 100.0 g |
| Sodium bisulfite | 20.0 g |
| Sodium methabisulfite | 5.0 g |
| Water is added to make one liter, and to adjust a pH to 7.0 with sulfuric acid. (oxidation-reduction potential: 70 mV) | |

2) latent image stability

Samples were exposed using an optical wedge, and then left to stand under a 80% RH condition at 25° C. for 16 hours. Thereafter, the treatment similar to the aforesaid fogginess evaluation and the determination of red density were carried out to determine a sensitivity ($S_1$), thereby determining a latent image stability as a ratio $S_1/S_2$ of the sensitivity $S_1$ to the sensitivity $S_2$ determined by conducting such treatment within 10 minutes after exposure for comparison. The results are given in Table III.

TABLE III

| Sample No. | Fogginess | Latent image stability ($S_1/S_2$) |
|---|---|---|
| 1 | 0.003 | 0.76 |
| 2* | 0.004 | 0.97 |
| 3* | 0.005 | 0.99 |
| 4* | 0.004 | 0.98 |
| 5 | 0.003 | 0.79 |
| 6 | 0.003 | 0.74 |
| 7 | 0.012 | 0.97 |
| 8 | 0.015 | 0.98 |
| 9* | 0.004 | 0.96 |
| 10* | 0.003 | 0.95 |

*A sample according to the present invention.

A whiteness desired for a color light-sensitive printing material is required to be 0.005 or less in fogginess and to be 0.95 or in latent more image stability ($S_1/S_2$). It is apparent from Table III that only the samples 2, 3, 4, 9 and 10 according to the present invention satisfy both of the above two characteristics.

The dark-keeping property and sharpness of the samples of the present invention were confirmed as in the prior art.

EXAMPLE 2

The following sample was prepared in the same manner as in Example 1, and the characteristics of the color dye images were determined.

A paper support covered over with a polyethylene containing anatase-type titanium dioxide as a white pigment was pretreated by subbing a gelatin, and the following layers were coated on the pretreated support in turns to prepare a sample.

Layer 1: a blue-sensitive silver chlorobromide emulsion layer.

This layer was formed using an emulsified dispersion made by dissolving in dioctyl phthalate silver chlorobromide emulsion containing 5% of silver chloride, as well as the aforesaid yellow coupler (Y1) and 2,5-di-tert-octylhydroquinone.

Layer 2: a first interlayer.

This layer was applied using an emulsified dispersion produced by dissolving 2,5-di-tert-octylhydroquinone in dioctyl phthalate.

Layer 3: a green-sensitive silver chlorobromide emulsion layer.

This layer was formed by use of the mixture of an aqueous solution of a dye in Table V with an emulsified dispersion made by dissolving in dioctyl phthalate silver chlorobromide emulsion containing 15 mole % of silver chloride, as well as the above-described magenta coupler (M-1) and 2,5-di-tert-octylhydroquinone.

Layer 4: a second interlayer.

An aqueous solution of a dye given in Table V was added to an emulsified dispersion made by dissolving the said ultraviolet absorbent (UV-1) and 2,5-di-tert-octylhydroquinone in dioctly phthalate, and the resulting mixture was applied to form this layer.

Layer 5: red-sensitive silver chlorobromide emulsion layer.

This layer was formed using an emulsified dispersion made by dissolving an dioctyl phthalate silver chlorobromide emulsion containing 25 mole % of sliver chloride, a cyan coupler given in Table V and 2,5-di-tert-octylhydroquinone.

Layer 6: a third interlayer.

This layer was formed of an emulsified dispersion made by dissolving in dioctyl phthalate the aforesaid ultraviolet absorbent (UV-1) and 2,5-di-tert-octylhydroquinone.

Layer 7: a protective layer.

This layer was formed using essentially a gelatin and a hardener.

The respective amounts of components in each the layers are given in Table IV. (The application amount: mg per 100 cm$^2$)

TABLE IV

| Layer | Silver halide emulsion | Coupler and ultraviolet coupler | 2,5-di-tert-octylhydroquinone | Gelatin |
|---|---|---|---|---|
| Layer 1 | 3 in terms of silver* | (Y-1) 8 | 0.5 | 20 |
| Layer 2 | first Interlayer | — | 1.0 | 10 |
| Layer 3 | 4 in terms of silver** | (M-1) 5 | 0.5 | 15 |
| Layer 4 | second interlayer | (UV-1) 7 | 1.0 | 10 |
| Layer 5 | 3 in terms of silver*** | as given in Table V | 0.5 | 15 |
| Layer 6 | third interlayer | (UV-1) 3 | 0.5 | 15 |
| Layer 7 | protective layer | — | — | 10 |

*A blue-sensitive silver chlorobromide emulsion
**A green-sensitive silver chlorobromide emulsion
***A red-sensitive silver chlorobromide emulsion On the basis of the above arrangement of layers, ten samples given in Table V were prepared by altering the cyan coupler in the red-sensitive silver chlorobromide emulsion and the dyes in the green-sensitive silver chlorobromide emlusion layer and layer 4 (second interlayer), respectively.

TABLE V

| Sample | Green-sensitive silver chlorobromide emulsion layer dye: mg/100 cm$^2$ | Interlayer (layer 4) dye: mg/100 cm$^2$ | Red-sensitive chlorobromide emulsion layer coupler: mg/100 cm$^2$ |
|---|---|---|---|
| 11 | — | — | I-28 4 |
| 12 | II-7 0.08 | — | the same |
| 13 | II-7 0.16 | — | the same |
| 14 | — | II-7 0.08 | the same |
| 15 | — | A-1 0.08 | the same |
| 16 | A-1 0.08 | — | the same |
| 17 | II-7 0.08 | — | C-1 4 |
| 18 | — | II-7 0.08 | the same |
| 19 | II-14 0.08 | — | I-26 4 |
| 20 | II-17 0.08 | — | I-15 4 |

The ten samples prepared in this manner were evaluated in fogginess and latent image stability in the same manner as in Example 1. The result are listed in Table VI.

TABLE VI

| Sample No. | Fogginess | Latent image stability ($S_1/S_2$) |
|---|---|---|
| 11 | 0.002 | 0.72 |
| 12* | 0.003 | 0.96 |
| 13* | 0.003 | 0.98 |
| 14* | 0.003 | 0.98 |
| 15 | 0.002 | 0.69 |
| 16 | 0.003 | 0.75 |

TABLE VI-continued

| Sample No. | Fogginess | Latent image stability ($S_1/S_2$) |
|---|---|---|
| 17 | 0.010 | 0.95 |
| 18 | 0.012 | 0.93 |
| 19* | 0.003 | 0.97 |
| 20* | 0.004 | 0.98 |

*A sample according to the present invention.

In Example 2, it is evident from Table VI that only the samples (Nos. 12, 13, 14, 19 and 20) according to the present invention satisfy both the characteristics of fogginess and latent image stability as in Example 1.

What is claimed is:

1. A silver halide photographic light-sensitive material comprising on a support a compound represented by Formula I and a compound represented by Formula II:

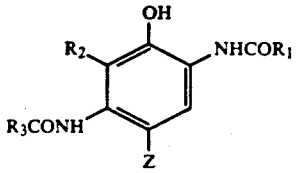

I wherein $R_1$ represents and alkyl, cycloalkyl, aryl, heterocyclic, alkoxy, aryloxy, alkylamino or arylamino group; $R_2$ represents a hydrogen atom, a halogen atom, an alkyl or alkoxy group; $R_3$ represents an alkyl, cycloalkyl or aryl group; and Z represents a hydrogen atom, or a group releasable by the coupling reaction with the oxidation product of an organic primary amine color developing agent, provided that $R_2$ and $R_3$ may be bonded together to form a 5-or 6-membered ring condensed to the phenolic ring; and

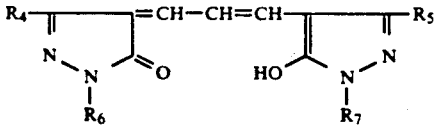

II wherein $R_4$ and $R_5$ are respectively -COOH or -COOR' wherein R' represents an alkyl group; and $R_6$ and $R_7$ are respectively an aryl group containing at least one sulfonic acid group.

2. A silver halide photographic light-sensitive material according to claim 1, wherein the compound represented by Formula I is further defined as a compound represented by Formula IV:

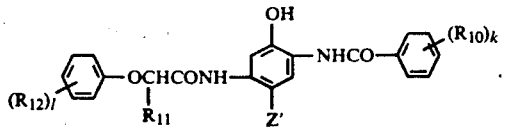

wherein $R_{10}$ represents a halogen atom, an alkylsulfonamide, an arylsulfonamide, an alkylsulfamoyl, an arylsulfamoyl, an alkyloxycarbonyl, an aryloxycarbonyl or an alkyl group; $R_{11}$ represents an alkyl group; $R_{12}$ represents an alkyl group, an alkylsulfonamide, an alkylsulfamoyl, an alkoxy, an alkylaminosulfonamide, an alkyloxycarbonyl or an aryloxycarbonyl group; Z' represents a hydrogen atom or a halogen atom; k and l each represent an integer of 0 to 5.

3. A silver halide photographic material according to claim 1, wherein the compound represented by Formula II is further defined as a compound represented by Formula V:

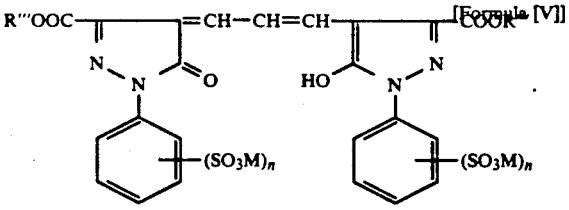

[Formula V]

wherein R''' is hydrogen or an alkyl group, n is an integer of from 2 to 5, and M represents hydrogen or a monovalent metal atom.

4. A silver halide photographic light-sensitive material according to claim 1, wherein said material further comprises a pivaloyl-acetoamide type yellow coupler.

5. A silver halide photographic material according to claim 1, wherein said support is light-reflective.

6. A silver halide photographic material according to claim 1, wherein said material comprises, in order, a blue-light-sensitive silver halide emulsion layer, a green-light-sensitive silver halide emulsion layer and a red-light-sensitive emulsion layer on said support.

7. A silver halide photographic light-sensitive material according to claim 1, wherein said material further comprises a 3-anilino-5-pyrazolone type magenta coupler.

* * * * *

UNITED STATES PATENT AND TRADEMARK OFFICE

CERTIFICATE OF CORRECTION

PATENT NO. : 5,139,930

DATED : August 18, 1992

INVENTOR(S) : Takashi Kadowaki et al

It is certified that error appears in the above-indentified patent and that said Letters Patent is hereby corrected as shown below:

Claim 1, column 35, line 28, change "and" to --an--.

Claim 3, column 36, lines 25-32, delete formula V

" 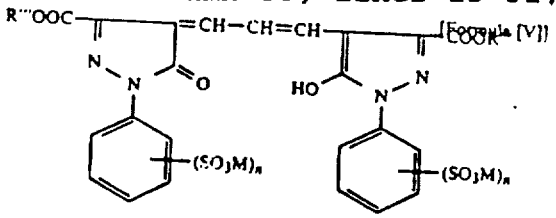 "

and insert therefor

-- 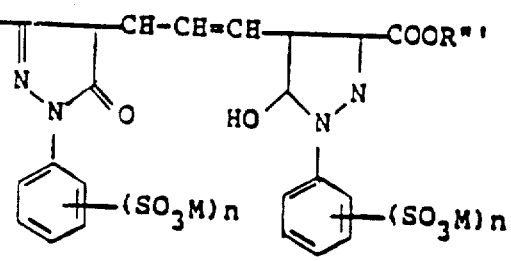 --.

V

Signed and Sealed this

Eighth Day of February, 1994

Bruce Lehman

Attest:

BRUCE LEHMAN

Attesting Officer

Commissioner of Patents and Trademarks